US011802014B2

(12) United States Patent
Maeda et al.

(10) Patent No.: US 11,802,014 B2
(45) Date of Patent: Oct. 31, 2023

(54) SHEET-SHAPED-MEDIUM FEEDER AND SHEET-SHAPED-MEDIUM HANDLING APPARATUS

(71) Applicant: FUJIFILM Business Innovation Corp., Tokyo (JP)

(72) Inventors: Shoichi Maeda, Kanagawa (JP); Masahito Niwa, Kanagawa (JP); Yuichi Araki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 302 days.

(21) Appl. No.: 17/225,140

(22) Filed: Apr. 8, 2021

(65) Prior Publication Data

US 2022/0081235 A1 Mar. 17, 2022

(30) Foreign Application Priority Data

Sep. 11, 2020 (JP) ..... 2020-153048

(51) Int. Cl.
*B65H 3/08* (2006.01)
*B65H 1/08* (2006.01)
*B65H 3/54* (2006.01)

(52) U.S. Cl.
CPC ..... *B65H 3/08* (2013.01); *B65H 1/08* (2013.01); *B65H 3/54* (2013.01)

(58) Field of Classification Search
CPC ... B65H 3/34; B65H 3/08; B65H 3/54; B65H 3/48
See application file for complete search history.

(56) References Cited

U.S. PATENT DOCUMENTS 7,540,489 B2 * 6/2009 Kushida ..... B65H 3/128 271/145
8,276,905 B2 * 10/2012 Suzuki ..... G03G 15/6502 271/104

(Continued)

FOREIGN PATENT DOCUMENTS

JP 6384275 9/2018

*Primary Examiner* — Howard J Sanders
(74) *Attorney, Agent, or Firm* — JCIPRNET

(57) ABSTRACT

A sheet-shaped-medium feeder includes a housing, a mount portion that is disposed to be vertically movable in the housing and that receives sheet-shaped media, a lift that vertically raises or lowers the mount portion, a discharger that transports the sheet-shaped media stacked on the mount portion to a transport portion by sucking the sheet-shaped media with a suction portion in order from an upper one of the sheet-shaped media, left and right side walls that come into contact with left and right edges, in a feed width, of the sheet-shaped media stacked on the mount portion, left and right air outlets that are disposed in the left and right side walls, and blow air to the sheet-shaped media stacked on the mount portion at the left and right edges in the feed width, left and right first limiters that are respectively disposed on the left and right side walls, and limit a height of at least one of the sheet-shaped media that floats with air blown by the left and right air outlets by coming into contact with an upper surface of the at least one sheet-shaped medium, and left and right second limiters that are disposed in areas between a suction area of the suction portion and the left and right side walls, and limit a height of the upper surface of the floating sheet-shaped medium by coming into contact with the upper surface.

14 Claims, 11 Drawing Sheets

(56) References Cited

U.S. PATENT DOCUMENTS

| | | | | |
|---|---|---|---|---|
| 8,740,214 | B2 * | 6/2014 | Onodera | B65H 3/128<br>271/94 |
| 9,359,157 | B2 | 6/2016 | Niikura et al. | |

* cited by examiner

SHEET-SHAPED-MEDIUM FEEDER AND SHEET-SHAPED-MEDIUM HANDLING APPARATUS

CROSS-REFERENCE TO RELATED APPLICATIONS

This application is based on and claims priority under 35 USC 119 from Japanese Patent Application No. 2020-153048 filed Sep. 11, 2020.

BACKGROUND

(i) Technical Field

The present disclosure relates to a sheet-shaped-medium feeder and a sheet-shaped-medium handling apparatus.

(ii) Related Art

Japanese Patent No. 6384275 (for example, see paragraphs 0010 and 0055, and FIGS. 3 to 7 and 17) describes a sheet feeder including a tray bottom board, serving as a mount board that receives sheets, and a long-size option that includes an extension bottom board, serving as an extension board formed to extend the tray bottom board upstream in a sheet transportation direction to allow long sheets to be stacked thereon.

Japanese Patent No. 6384275 (for example, see paragraphs 0010 and 0055, and FIGS. 3 to 7 and 17) also describes that the sheet feeder employs an air-separation sheet feeding system involving blowing air to the long sheets with an air blower installed in a side fence or a downstream wall of a sheet feed tray to float the downstream end portions of the long sheets in the transportation direction toward a transport belt, and sucking the floated long sheet with the transport belt to transport the long sheet.

SUMMARY

Aspects of non-limiting embodiments of the present disclosure relate to a sheet-shaped-medium feeder and a sheet-shaped-medium handling apparatus that include a discharger including a suction portion, left and right side walls, and left and right second limiters. The left and right second limiters are disposed in areas between a suction area of the suction portion and the left and right side walls, and come into contact with an upper surface of a sheet-shaped medium to limit the height of the sheet-shaped medium. The sheet-shaped-medium feeder and the sheet-shaped-medium handling apparatus further prevent a sheet-shaped medium that floats in the areas between the suction area and the left and right side walls to be bent in a convex shape, than in a structure that does not include the left and right second limiters.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet-shaped-medium feeder that includes a housing, a mount portion that is disposed to be vertically movable in the housing and that receives sheet-shaped media, a lift that vertically raises or lowers the mount portion, a discharger that transports the sheet-shaped media stacked on the mount portion to a transport portion by sucking the sheet-shaped media with a suction portion in order from an upper one of the sheet-shaped media, left and right side walls that come into contact with left and right edges, in a feed width, of the sheet-shaped media stacked on the mount portion, left and right air outlets that are disposed in the left and right side walls, and blow air to the sheet-shaped media stacked on the mount portion at the left and right edges in the feed width, left and right first limiters that are respectively disposed on the left and right side walls, and limit a height of at least one of the sheet-shaped media that floats with air blown by the left and right air outlets by coming into contact with upper surfaces of the left and right edges, and left and right second limiters that are disposed in areas between a suction area of the suction portion and the left and right side walls, and limit a height of an upper surface of the floating sheet-shaped medium by coming into contact with the upper surface.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
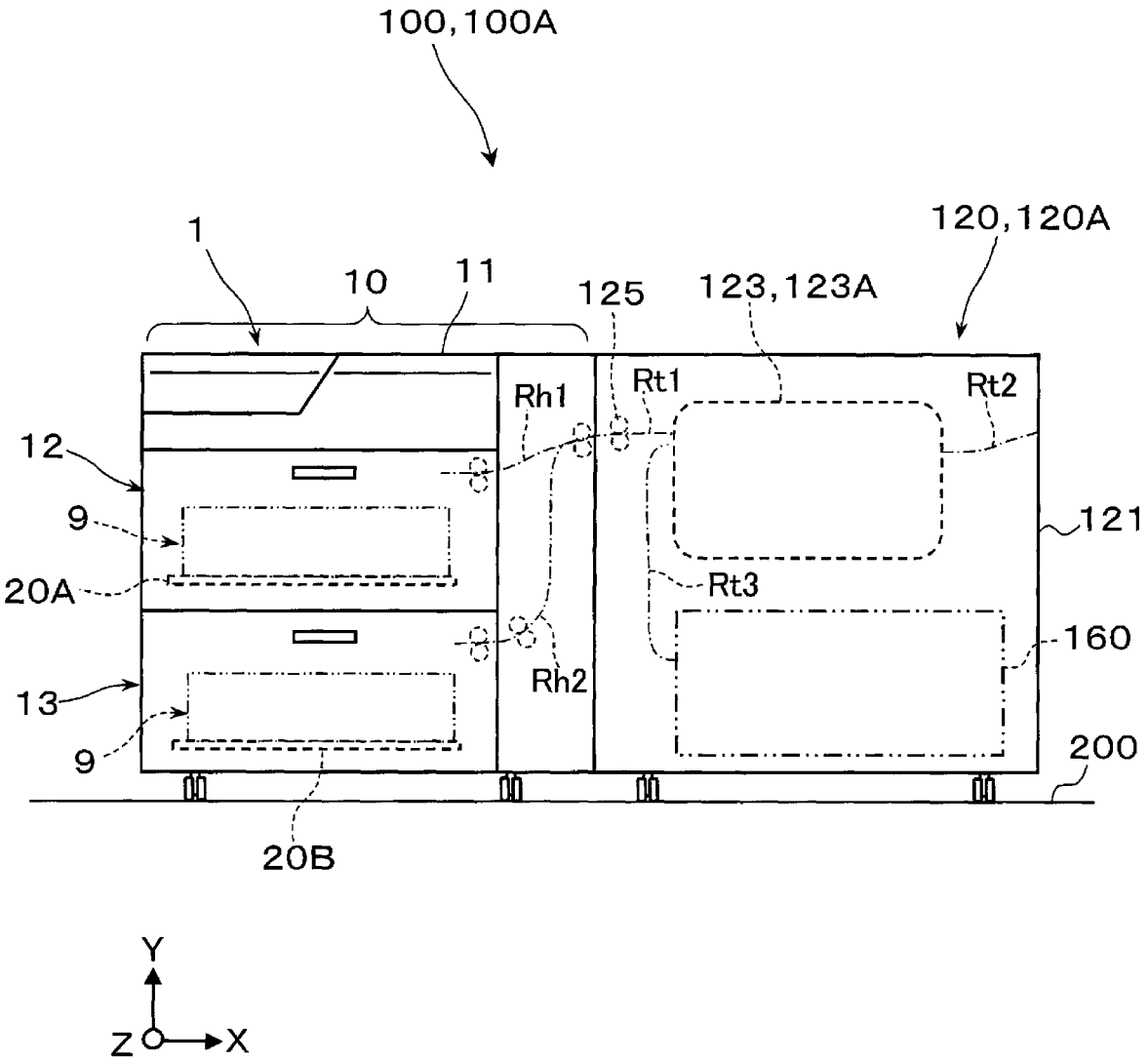
FIG. 1 is a side view of a sheet-shaped-medium handling apparatus according to a first exemplary embodiment.
Figure 2:
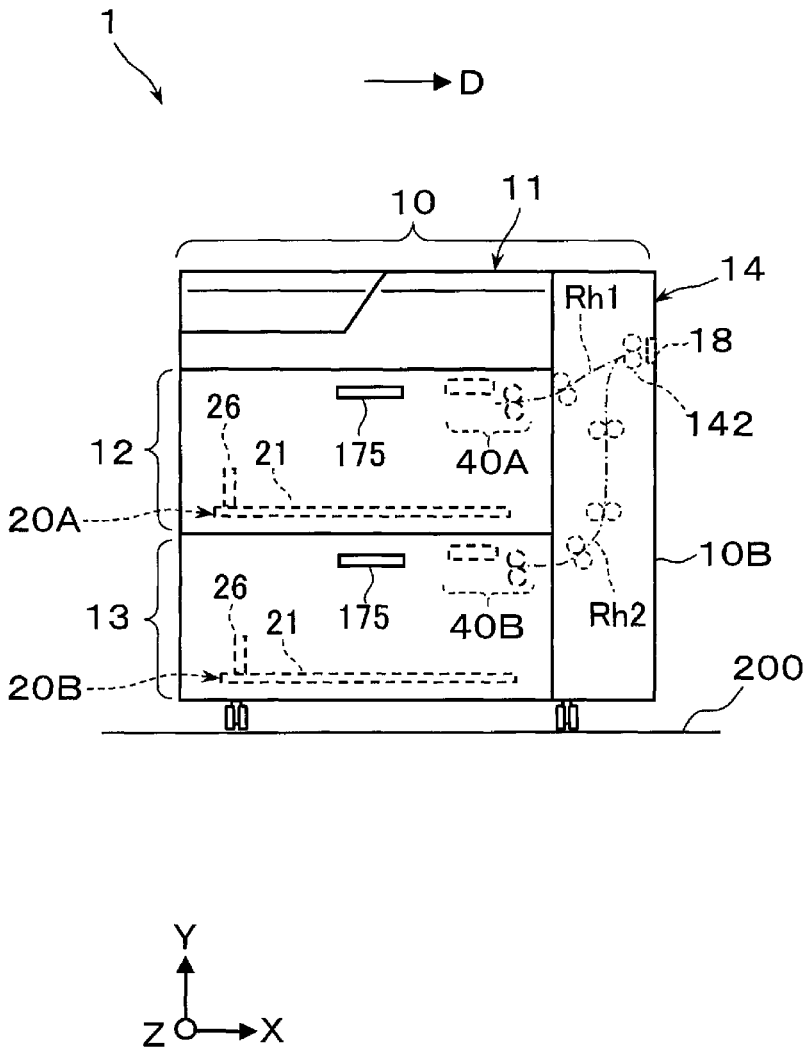
FIG. 2 is a side view of a sheet-shaped-medium feeder according to the first exemplary embodiment.

FIG. 1 illustrates a sheet-shaped-medium handling apparatus 100 according to a first exemplary embodiment of the present disclosure. FIG. 2 illustrates a sheet-shaped-medium feeder 1 according to the first exemplary embodiment.

In the following description, throughout the drawings, the direction indicated with arrow X is referred to as an apparatus width direction, the direction indicated with arrow Y is referred to as an apparatus height direction, and the direction indicated with arrow Z is referred to as an apparatus depth direction perpendicular to the width direction and the height direction. A circle in the drawings at the intersection of the arrow X and the arrow Y denotes the apparatus depth direction (arrow Z) directing downward of the drawing sheet, or perpendicular to the drawing sheet.

Sheet-Shaped-Medium Handling Apparatus

As illustrated in FIG. 1, the sheet-shaped-medium handling apparatus 100 includes the sheet-shaped-medium feeder 1, which transports and feeds sheet-shaped media 9 stacked thereon, and a processing device 120, which performs processing on the sheet-shaped media 9 fed from the feeder 1.

The sheet-shaped media 9 are sheet-like media that are receivable in and transportable by the feeder 1 and transportable and processible by the processing device 120. An image forming system 100A and other portions are installed on an installation surface 200 illustrated in FIG. 1.

The sheet-shaped-medium handling apparatus 100 according to the first exemplary embodiment includes an image forming apparatus 120A that forms images on the sheet-shaped media 9 to serve as the processing device 120. The processing device 120 is connected to and combined with the feeder 1 to form the image forming system 100A.

In the first exemplary embodiment, examples used as the sheet-shaped media 9 include recording media that allow images to be formed thereon, such as sheets, coated paper, films, foil, and sheet-like cloth cut into predetermined sizes.

As illustrated in FIG. 1, the image forming apparatus 120A, serving as an example of the processing device 120, includes an image forming unit 123A and a transport path Rt inside a housing 121 with a predetermined profile. The image forming unit 123A forms images on the sheet-shaped media 9 and serves as an example of a processing unit 123. The transport path Rt allows the sheet-shaped media 9 to be transported along itself inside the housing 121.

The image forming unit 123A has, for example, an image forming system such as an electrophotographic system or an inkjet recording system. However, the image forming system, layout, the number of units, and other details are not limited to particular ones. An introduction transport path Rt1 indicated with a dot-and-dash line in FIG. 1 allows the sheet-shaped media 9 fed from the feeder 1 to be transported along itself and introduced into the image forming unit 123A. The introduction transport path Rt1 includes transport rollers 125, and a transport guide. A discharge transport path Rt2 indicated with a dot-and-dash line allows the sheet-shaped media 9 that have passed the image forming unit 123A to be transported along itself and discharged to a receiving portion or a post-processing unit, not illustrated. The discharge transport path Rt2 includes transport rollers and a transport guide, not illustrated.

In the image forming system 100A, when the sheet-shaped media 9 are fed from the feeder 1 to the image forming apparatus 120A, which is an example of the processing device 120, the image forming apparatus 120A forms images on the fed sheet-shaped media 9. Forming images is an example of processing performed on the sheet-shaped media 9.

As indicated with a chain double-dashed line in FIG. 1, the image forming apparatus 120A may include, inside the housing 121, a sheet-shaped medium internal feeding unit 160 that accommodates the sheet-shaped media 9 and feeds the sheet-shaped media 9 to the image forming unit 123A. When including the internal feeding unit 160, the image forming apparatus 120A includes a second introduction transport path Rt3 disposed to connect the internal feeding unit 160 and the image forming unit 123A. The image forming apparatus 120A including the internal feeding unit 160 is also usable by being combined with the sheet-shaped-medium feeder 1 serving as an external feeding unit.

Sheet-Shaped-Medium Feeder

As illustrated in FIGS. 1 and 2, the sheet-shaped-medium feeder 1 includes a housing 10 that is a body accommodating and feeding the sheet-shaped media 9.

The housing 10 includes a support frame forming a predetermined skeleton structure, and an exterior panel forming the appearance. As illustrated in the drawings such as FIGS. 1 to 3, the housing 10 roughly includes an upper portion 11, feed units 12 and 13 located below the upper portion 11 and vertically stacked one on the other (upper and lower units), and a discharge portion 14 disposed at an end of the upper portion 11 and the feed units 12 and 13 on one side.

As illustrated in FIGS. 1 to 5 and other drawings, the feed unit 12 on the upper side and the feed unit 13 on the lower side include containers 17A and 17B, such as trays, mount portions 20A and 20B that receive the sheet-shaped media 9 (FIG. 1), a lift 30 that vertically raises and lowers the mount portions 20A and 20B inside the containers 17A and 17B, and dischargers 40A and 40B that discharge the sheet-shaped media 9 respectively stacked on the mount portions 20A and 20B toward the discharge portion 14 in the direction of arrow D (in the transportation direction D).

The containers 17A and 17B are attached to be drawable to the near side (upstream side in the apparatus depth direction Z) of the housing 10. The containers 17A and 17B each include a body 170 (FIG. 4), front walls 172, a leading-end wall 173, and a moving device, not illustrated. The body 170 has a rectangular open-top box shape with a side portion open. The front walls 172 are disposed on the near side surface of the body 170. The leading-end wall 173 vertically guides downstream ends of the mount portions 20A and 20B in the transportation direction D, to align the leading ends of the sheet-shaped media 9 stacked on the mount portions 20A and 20B for positioning. The leading ends are disposed downstream in the transportation direction D. The moving device includes slide rails and a latch mechanism disposed between the left and right side portions of the body 170 in the pull-out direction and the inner wall of the housing 10.

Figure 4:
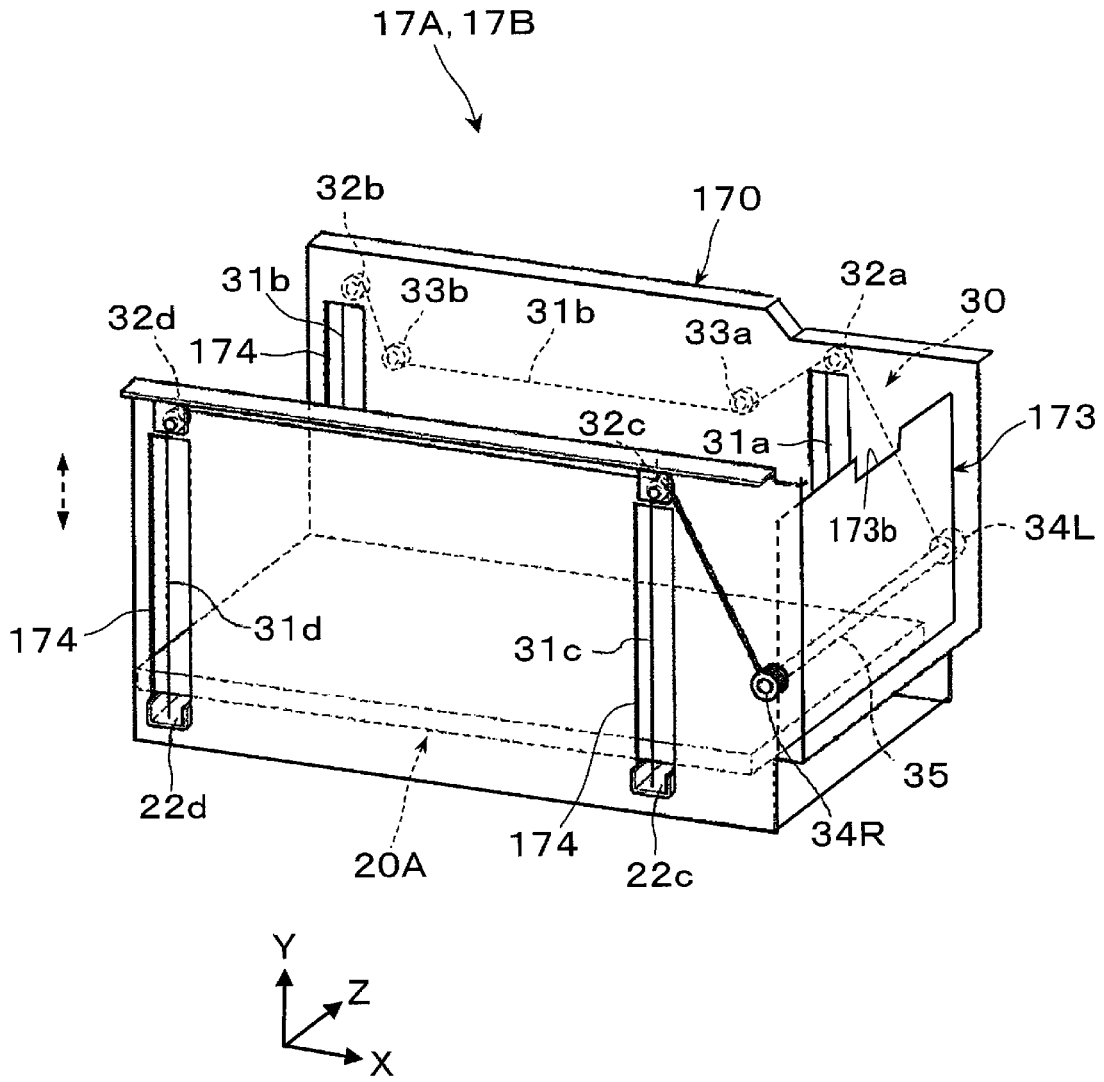
FIG. 4 is a perspective view of a lift and an unchanged mount portion in the feeder illustrated in FIG. 2.

As illustrated in FIG. 4, the leading-end wall 173 has a cut recess 173*b* at the middle at the upper end of the leading-end wall 173. The recess 173*b* enables, for example, checking of existence of the sheet-shaped media 9 stacked on the mount portion 20A or 20B.

The containers 17A and 17B each include a pull opening 175 in an upper portion of the corresponding front wall 172, and includes a handle in the pull opening 175. The handle unlocks the containers 17A and 17B stored in the housing 10. The handle is not illustrated. The containers 17A and 17B are thus each drawn out of the housing 10 by being pulled to the near side of the housing 10 while the pull opening 175 and the handle are gripped, and allow the sheet-shaped media 9 to be stacked on the mount portions 20A and 20B.

The mount portions 20A and 20B are plate members having a mount surface 21 that receives the sheet-shaped media 9 on the upper portion. The mount portions 20A and 20B are disposed to be vertically movable in the containers 17A and 17B.

Figure 3:
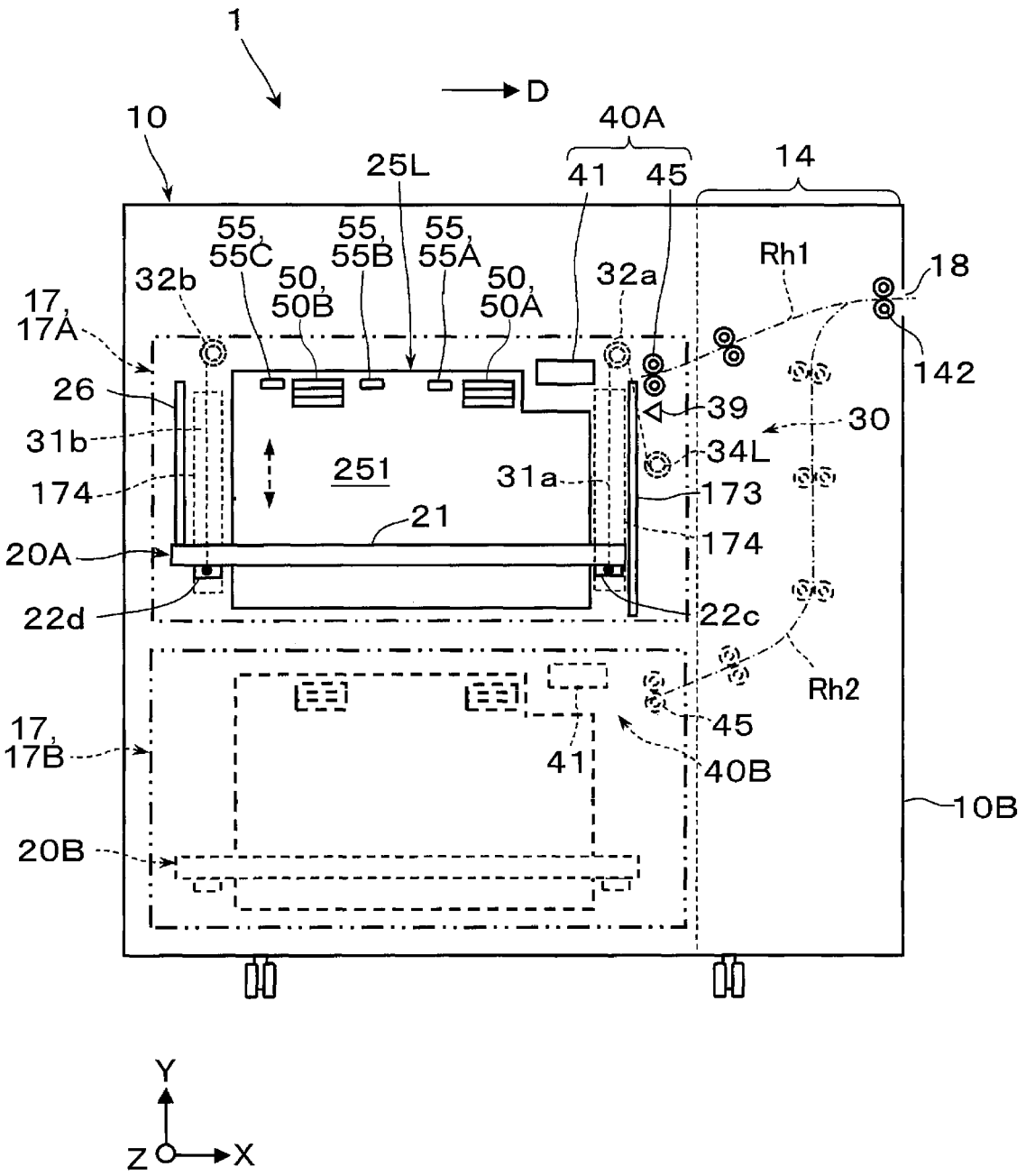
FIG. 3 is a schematic side view of part of the inside of the feeder illustrated in FIG. 2.
Figure 5:
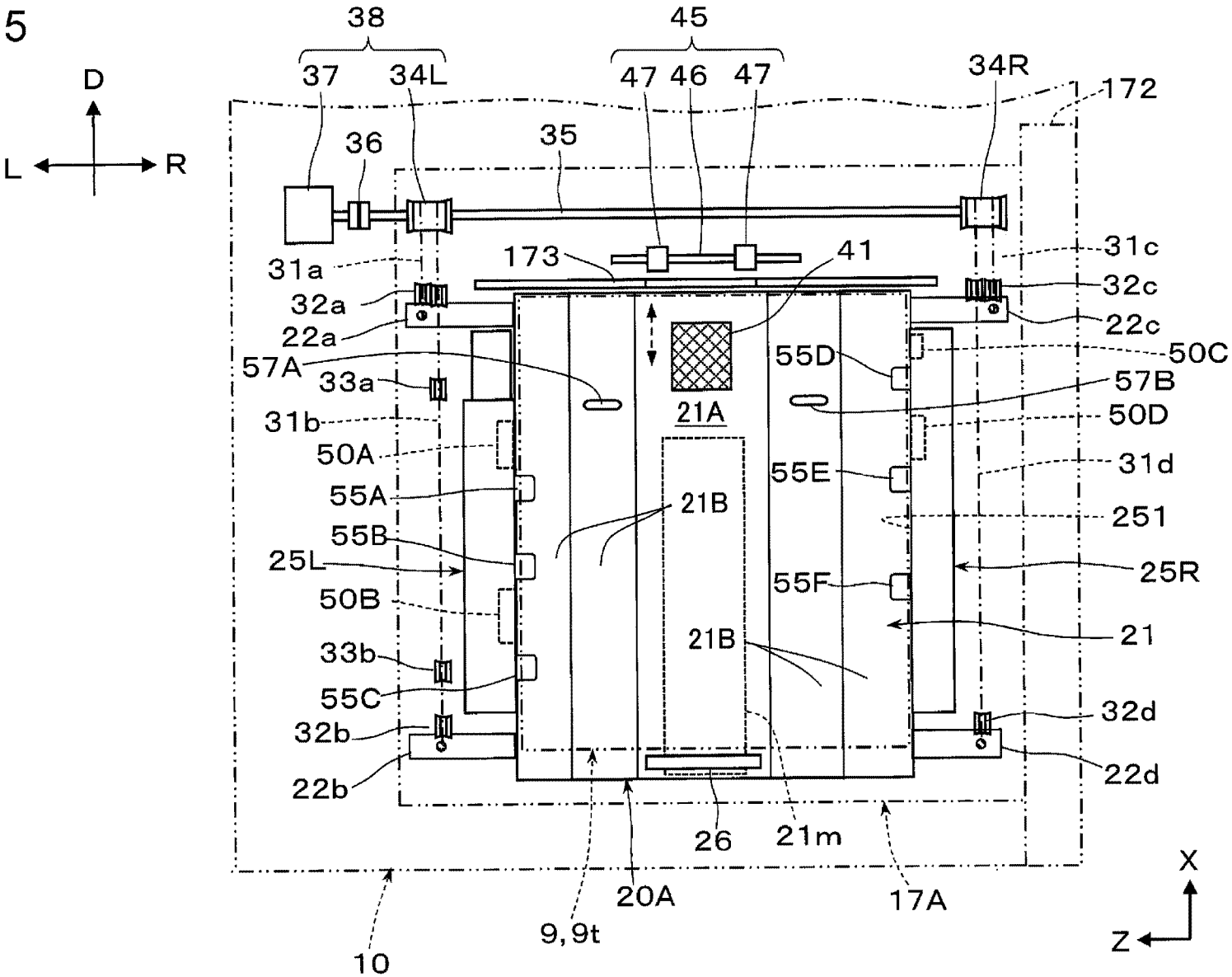
FIG. 5 is a schematic plan view of a mount portion of the feeder illustrated in FIG. 2 and the surroundings of the mount portion.

The mount portion 20A among the mount portions 20A and 20B is described as an example. As illustrated in FIGS. 3 to 5 and other drawings, the mount portion 20A includes four hanging portions 22*a*, 22*b*, 22*c*, and 22*d* protruding outward at the left and right edges. The hanging portions 22*a*, 22*b*, 22*c*, and 22*d* are disposed at four positions, that is, two positions in the transportation direction D at each of left and right edges in the left and right directions L and R, where the left and right directions L and R cross the transportation direction D in which the sheet-shaped media 9 on the mount portion 20A are discharged by the discharger 40A.

In the first exemplary embodiment, the right direction R is on the near side (front side) of the apparatus, and the left direction L is on the far side (rear side) of the apparatus.

As illustrated in FIGS. 3 and 4 and other drawings, the mount portion 20A is attached while having the hanging portions 22*a*, 22*b*, 22*c*, and 22*d* fitted, from the inner side of the container 17A, into four guide holes 174 in the near and far side walls of the body 170 of the container 17A. The guide holes 174 are, for example, rectangular openings linearly extending through by a predetermined length in the vertical direction (in the apparatus height direction Y) indicated with a broken double-pointed arrow.

Thus, the mount portion 20A is vertically movable in the body 170 of the container 17A while having the hanging portions 22*a*, 22*b*, 22*c*, and 22*d* being guided along the guide holes 174. The mount portion 20A is movable by a length of the guide holes 174 in the vertical direction.

The mount portion 20B also has a structure substantially similar to the above structure relating to the vertical movement of the mount portion 20A. Instead of long through-holes, the guide holes 174 may be guide grooves extending linearly.

As illustrated in FIGS. 2, 3, and 5 and other drawings, the mount portions 20A and 20B each include left and right side walls 25L and 25R and a rear end wall 26. The left and right side walls 25L and 25R come into contact with left and right edges of the sheet-shaped media 9 stacked on the corresponding mount surface 21 to guide the left and right edges in the transportation direction D. The rear end wall 26 aligns the trailing ends of the sheet-shaped media 9, on the upstream side in the transportation direction D, to fix the position of the trailing ends.

The side walls 25L and 25R each include a contact surface 251 (FIG. 5) that comes into contact with the left or right edges of the sheet-shaped media 9. The side walls 25L and 25R are movable as a whole in the left and right directions L and R over the bottom of the body 170 of the container 17A or 17B, since the feed units 12 and 13 transport the sheet-shaped media 9 while using the center position of the sheet-shaped media 9 in the feed width direction as a reference position for transportation, that is, while employing a center registration method. Thus, the side walls 25L and 25R are moved to the positions corresponding to the positions of the left and right edges of the sheet-shaped media 9 for adjustment.

The rear end wall 26 has a contact surface that comes into contact with the trailing ends of the sheet-shaped media 9. The entirety of the contact surface is movable with respect to slide grooves 21*m*, extending in the transportation direction D and formed in a fixed surface portion 21A of the mount surface 21. Thus, the rear end wall 26 is moved to the position corresponding to the position of the trailing ends of the sheet-shaped media 9 for adjustment.

The mount portions 20A and 20B each have the mount surface 21 having the following two surface structures in accordance with the movement structures of the side walls 25L and 25R.

Specifically, the mount surface 21 includes a fixed surface portion and multiple slide surface portions. The fixed surface portion is fixed at the middle position in the left and right directions L and R to extend in the transportation direction D. The slide surface portions are disposed on the left and right sides of the fixed surface portion to be slidable in the left and right directions L and R in accordance with the movement of the side walls 25L and 25R.

As illustrated in FIG. 3 and other drawings, the side walls 25L and 25R each include multiple air outlets 50 in the contact surface 251. The air outlets 50 blow air to the left and right edges of the sheet-shaped media 9 stacked on the mount portions 20A and 20B.

In the first exemplary embodiment, as illustrated in FIG. 5 and other drawings, the left side wall 25L has two air outlets 50A and 50B spaced apart in the transportation direction D, and the right side wall 25R has two air outlets 50C and 50D spaced apart in the transportation direction D. The position of the air outlet 50A in the transportation direction D opposes the position of the air outlet 50D in the transportation direction D.

The air outlets 50A and 50B are connected to a fan duct including a built-in fan disposed out of the left side wall 25L (on the side opposite to the contact surface 251). The fan is not illustrated. The air outlets 50C and 50D are connected to a fan duct including a built-in fan disposed out of the right side wall 25R (on the side opposite to the contact surface 251). The fan is not illustrated.

In the feed units 12 and 13, air is blown from the air outlets 50A, 50B, 50C, and 50D to cause upper ones of the sheet-shaped media 9 stacked on the mount portions 20A and 20B to float in the air blown from the left and right edges and vertically separate from each other.

As illustrated in FIG. 3 and other drawings, the side walls 25L and 25R each include multiple height limiters 55 on the contact surface 251. The height limiters 55 come into contact with the upper surfaces of the left and right edge portions of the sheet-shaped media 9 stacked on the mount portions 20A and 20B to limit the upper surfaces to a predetermined height.

In the first exemplary embodiment, as illustrated in FIG. 5 and other drawings, the left side wall 25L has one height limiter 55A disposed upstream from the first air outlet 50A in the transportation direction D, and two height limiters 55B and 55C disposed apart from each other on both sides of, that is, downstream and upstream from the first air outlet 50B in the transportation direction D. The right side wall 25R has one height limiter 55D between the first air outlets 50C and 50D, and two height limiters 55E and 55F disposed apart from each other downstream from the first air outlet 50D in the transportation direction D.

These height limiters 55A to 55F are formed from, for example, plate members protruding by a predetermined length from a predetermined height of the contact surfaces 251 of the side walls 25L and 25R over and above the mount surfaces 21 of the mount portions 20A and 20B. During an operation of stacking the sheet-shaped media 9 on the mount surfaces 21 of the mount portions 20A and 20B (when the mount portion 20A and other components are moved to the lowermost position, as will be described below), the height limiters 55A to 55F are, for example, retracted in the side walls 25L and 25R without protruding from the contact surfaces 251.

The feed units 12 and 13 hold from above the left and right edges of the sheet-shaped media 9 floated by air discharged from the air outlets 50, to keep the sheet-shaped media 9 at a predetermined height from the mount surfaces 21 of the mount portions 20A and 20B.

The lift 30 is a device that vertically raises or lowers the mount portions 20A and 20B inside the containers 17A and 17B by hanging the mount portions 20A and 20B with wires 31, serving as an example of line members.

The lift 30 will be described using the mount portion 20A as an example. As illustrated in FIGS. 3 to 5 and other drawings, the lift 30 includes four wires 31*a*, 31*b*, 31*c*, and 31*d* having trailing ends respectively coupled to the hanging portions 22*a*, 22*b*, 22*c*, and 22*d* disposed at four positions of the mount portion 20A.

The lift 30 also includes winding pulleys 32*a*, 32*b*, 32*c*, and 32*d*, a left taking-up pulley 34L, a right taking-up pulley 34R, and auxiliary pulleys 33*a* and 33*b*. The winding pulleys 32*a*, 32*b*, 32*c*, and 32*d* are rotatably attached to portions in the container 17A above the upper ends of the guide holes 174 to have the wires 31*a*, 31*b*, 31*c*, and 31*d* wound therearound. The left taking-up pulley 34L takes up the wires 31*a* and 31*b* disposed on the left. The right taking-up pulley 34R takes up the wires 31*c* and 31*d* disposed on the right. The auxiliary pulleys 33*a* and 33*b* allow the wires 31*a* and 31*b* to be wound therearound so that the wires 31*a* and 31*b* are intendedly routed between the winding pulleys 32*a* and 32*b* and the left taking-up pulley 34L.

As illustrated in FIGS. 4 and 5, the lift 30 connects the left taking-up pulley 34L and the right taking-up pulley 34R with a rotation shaft 35, and connects the end portion of the rotation shaft 35 closer to the left taking-up pulley 34L to a driving device 37 (or a driving shaft thereof) via a detachably connectable coupling mechanism 36. The driving device 37 includes components including a motor and a gear mechanism. In the lift 30, the left taking-up pulley 34L, the right taking-up pulley 34R, and the driving device 37 form a winder 38 that takes up and unwinds the wires 31*a*, 31*b*, 31*c*, and 31*d*.

As illustrated in FIG. 3, the lift 30 in the feed unit 12 includes a position sensor 39 that detects the uppermost position of the sheet-shaped media 9 stacked on the mount portion 20A. The position sensor 39 is disposed, for example, to be capable of detecting the uppermost position of the sheet-shaped media 9 viewable through the cut recess 173*b* in the leading-end wall 173 of the container 17A.

When the driving device 37 in the lift 30 is driven to take up the wires 31*a*, 31*b*, 31*c*, and 31*d*, the mount portions 20A and 20B move upward, but the driving device 37 is controlled to stop driving upon receipt of detection information from the position sensor 39. Thus, upward movement of the mount portion 20A using the lift 30 is stopped when the uppermost position of the sheet-shaped media 9 reaches a predetermined height.

The mount portion 20B in the feed unit 13 on the lower side also includes a lift similar to the lift 30 in the mount portion 20A.

As illustrated in FIGS. 2, 3, and 5 and other drawings, the dischargers 40A and 40B each include a suction portion 41, a transport portion 45, and a guide member, not illustrated. The suction portion 41 sucks the uppermost one of the sheet-shaped media 9 stacked on the mount portion 20A or 20B to carry the uppermost medium 9. The transport portion 45 transports the sheet-shaped medium 9 sucked by the suction portion 41. The guide member forms a first transport path Rh1, described below.

The dischargers 40A and 40B are disposed separately from the containers 17A and 17B while being fixed to the housing 10. Thus, the dischargers 40A and 40B are fixed in position inside the housing 10 without moving regardless of when the containers 17A and 17B are drawn out of the housing 10.

Figure 6:
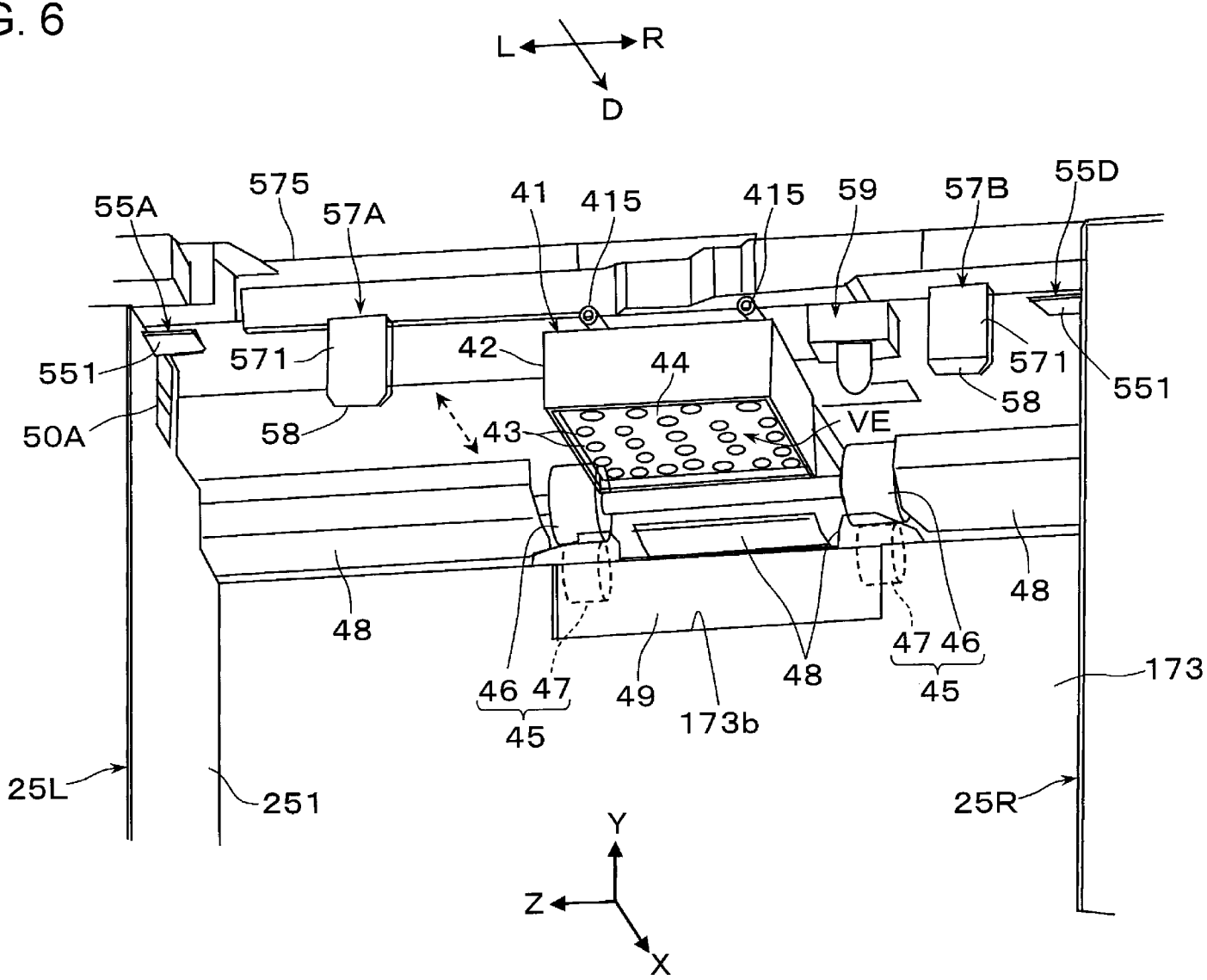
FIG. 6 is a schematic perspective view of part of the inside of the feeder illustrated in FIG. 2, viewed from obliquely below.

As illustrated in FIGS. 3, 5, and 6 and other drawings, the suction portion 41 is disposed to oppose the mount surface 21 of the mount portion 20A or 20B at the downstream end portion of the container 17A or 17B in the transportation direction D and at an upper portion inward from the leading-end wall 173.

Specifically, the suction portion 41 is formed as a suction head that includes a hollow cubic frame 42 with a lower surface open, a suction plate 44 including multiple inlet ports 43 arranged in a predetermined pattern, and intake tubes into which a single path is split and which are respectively connected to the multiple inlet ports 43. The suction plate 44 is disposed slightly above and inward from the lower opening of the frame 42. The intake tubes are not illustrated. The intake tubes are connected to a suction device disposed at the far side of the housing 10. The suction device is not illustrated.

This suction portion 41 performs a suction operation to suck the sheet-shaped media 9 while bringing the sheet-shaped media 9 into contact with a lower side 42*a* of the frame 42.

Thus, the suction portion 41 has a rectangular surface area surrounded by a lower side 42*a* of the frame 42 serving as a suction area VE (FIG. 6). The suction area VE of the suction portion 41 according to the first exemplary embodiment has an area approximately including a portion of the mount surface 21 of each of the mount portions 20A and 20B near the downstream end in the transportation direction D and opposing substantially the center portion in the left and right directions L and R crossing the transportation direction D.

Figure 7:
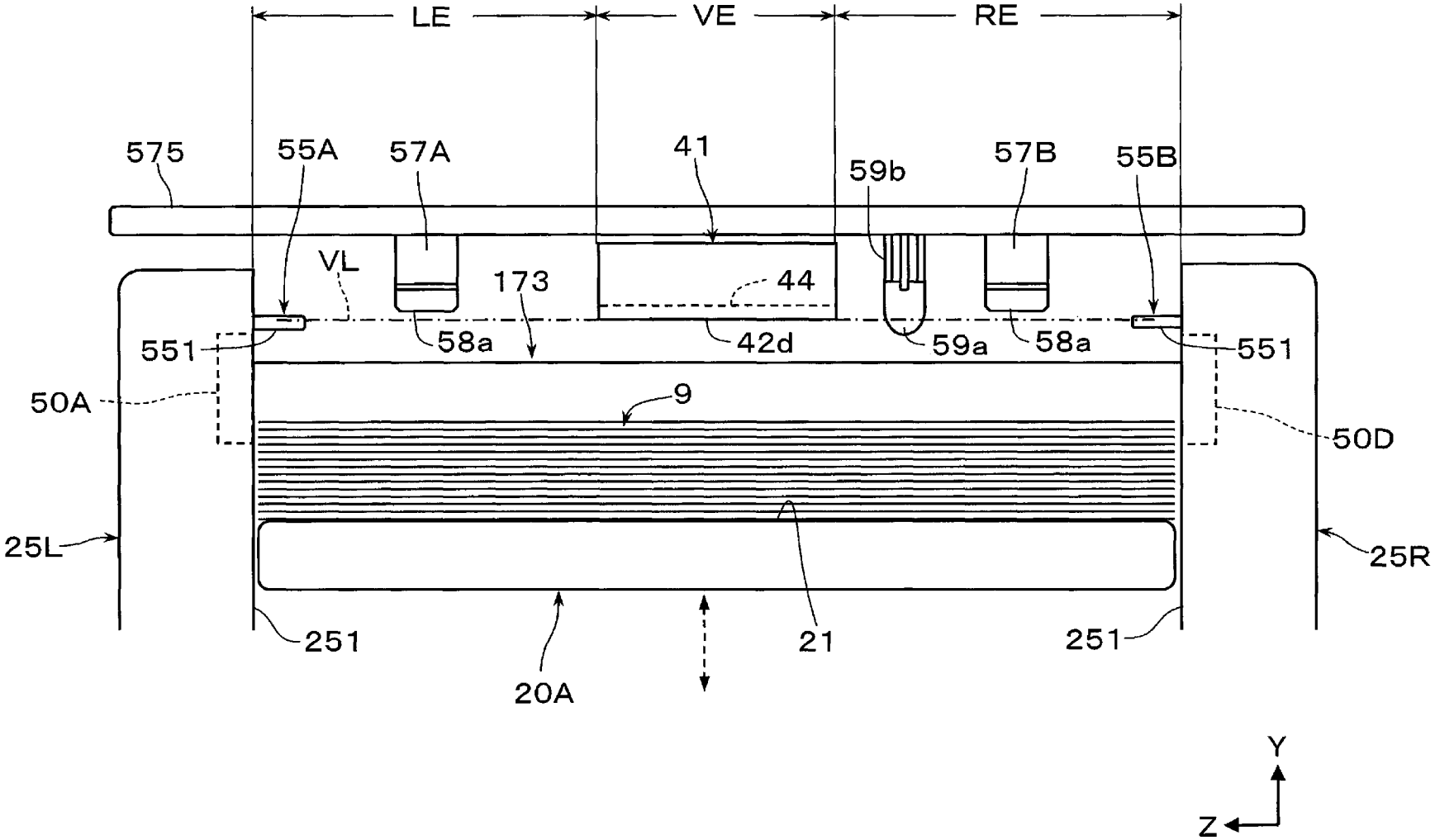
FIG. 7 is a schematic diagram of part of the feeder illustrated in FIG. 6, viewed from upstream in the transportation direction.

As illustrated in FIGS. 5, 6, and 7 and other drawings, the suction portion 41 is disposed upstream from the transport portion 45 in the transportation direction D to reciprocate in the transportation direction D at predetermined timing, as indicated with a broken double-pointed arrow.

Specifically, the suction portion 41 has support portions 42*b* at upper portions of the frame 42 movably attached to two guide rails 415 disposed above the support portions 42*b* to be parallel to the transportation direction D. The guide rails 415 are disposed on a support frame 418 fixed to part of the housing 10.

The suction portion 41 has connection portions 42*c* at upper portions of the frame 42 fixed to part of a movable belt 417 wound around a pair of pulleys 416 above the guide rails 415. The pair of pulleys 416 are spaced apart from each other on the upstream and downstream sides in the transportation direction D. The movable belt 417 drives the suction portion 41 by a predetermined distance in a predetermined direction. One of the pulleys 416 is driven to rotate by, for example, a driving device such as motor. The driving device is not illustrated.

Thus, the suction portion 41 is movable toward and away from the transport portion 45 during discharging.

The transport portion 45 in the feeder 1 is disposed outward from and downstream from the leading-end wall 173 of the container 17A or 17B in the transportation direction D, and downstream from the suction portion 41 in the transportation direction D.

The transport portion 45 includes, for example, a pair of transport rollers, and a transport guide member not illustrated. The pair of transport rollers include a driving transport roller 46 and driven transport rollers 47. The driving transport roller 46 includes a rotation shaft 461 and multiple transport rollers 462 attached to the rotation shaft 461. The driven transport rollers 47 are driven to rotate by coming into contact with a lower portion of the driving transport roller 46. The transport guide member defines a passage space of the first transport path Rh1. The rotation shaft 461 is driven to rotate by a driving device such as a motor during discharging. The driving device is not illustrated.

An introduction guide member 48 in FIG. 6 guides the leading ends of the sheet-shaped media 9 to introduce the leading ends into the rollers (a contact portion between the driving transport roller 46 and the driven transport rollers 47) of the transport portion 45 during discharging. A support portion 49 of a support frame supports the transport portion 45.

As illustrated in FIGS. 2 and 3, the discharge portion 14 in the housing 10 includes the first transport path Rh1 and a second transport path Rh2. Along the first transport path Rh1, the sheet-shaped media 9 are transported outward by the discharger 40A from the feed unit 12 on the upper side. Along the second transport path Rh2, the sheet-shaped media 9 are transported outward by the discharger 40B from the feed unit 13 on the lower side.

The first transport path Rh1 and the second transport path Rh2 are discharge transport paths extending up to discharge rollers 142 at a discharge port 18 in a side portion 10B of the housing 10 while merging midway. The first transport path Rh1 and the second transport path Rh2 each include pairs of transport rollers, drawn with broken lines, and a transport guide member not illustrated.

As illustrated in FIGS. 5 to 8 and other drawings, the feeder 1 also includes left and right second limiters 57A and 57B that limit the height of the sheet-shaped media 9 that float with air blown from the air outlets 50A, 50B, 50C, and 50D by coming into contact with the upper surface of the sheet-shaped medium 9.

As illustrated in FIGS. 5 and 7, the second limiters 57A and 57B are disposed in first areas LE and RE, which are between the suction area VE of the suction portion 41 and the left and right side walls 25L and 25R. Any number of the second limiters 57A and 57B may be located at any positions as long as the second limiters 57A and 57B are located within the first areas LE and RE. The second limiters 57A and 57B according to the first exemplary embodiment are respectively located at substantially the center positions in the first areas LE and RE.

Figure 8:
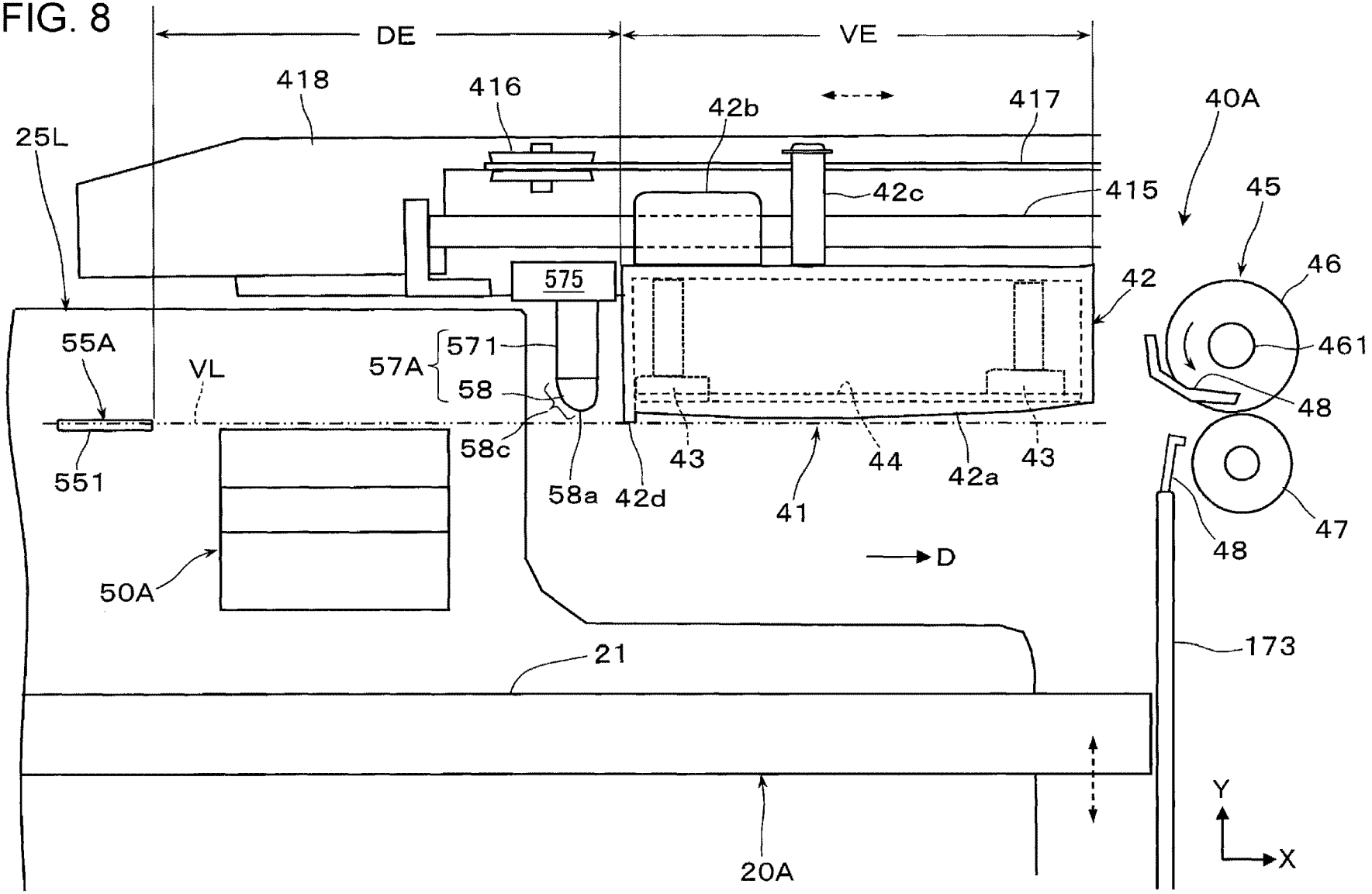
FIG. 8 is a schematic diagram of part of the feeder illustrated in FIG. 6, viewed sideways.

As illustrated in FIG. 8, the second limiters 57A and 57B are preferably located at least within a second area DE, extending beyond the suction area VE of the suction portion 41 to one of the left and right first limiters 55A and 55E disposed upstream in the transportation direction D for the sheet-shaped media 9 and closest to the suction area VE. Any number of the second limiters 57A and 57B may be located at any positions as long as they are located within the second area DE. The second limiters 57A and 57B according to the first exemplary embodiment are located one at each position in the second area DE closer to the suction area VE of the suction portion 41 than the center position.

In a structure where the second limiters 57A and 57B are located only within the suction area VE of the suction portion 41 in the transportation direction D for the sheet-shaped media 9, media may be transported in an unintended (misaligned) position such as skewing or may be partially deformed such as dog-eared.

The second limiters 57A and 57B each include a contact portion 58, contactable with the upper surface of the sheet-shaped media 9, and a support portion 571, which supports the contact portion 58. For example, the support portion 571 is fixed to, for example, part of a support frame 575 fixed to the housing 10. The contact portion 58 is disposed at the lower end of the support portion 571.

The contact portion 58 in each of the second limiters 57A and 57B has a shape long in the width direction (left and right directions L and R) crossing the transportation direction D for the sheet-shaped medium.

Specifically, the contact portion 58 has a dimension in the width direction (left and right directions L and R) relatively longer than the dimension in the transportation direction D. The contact portion 58 may have a dimension in the left and right directions L and R extending substantially throughout the first areas LE and RE. However, in consideration of surrounding circumstances including layout of other components, the contact portion 58 has a length corresponding to part of the first areas LE and RE.

As illustrated in FIGS. 6 and 8, the contact portion 58 has a convex shape, protruding downward when viewed in the transportation direction D for the sheet-shaped media 9. In view of reduction of frictional resistance at contact with the sheet-shaped media 9, examples of the convex shape include a semicircular (arc-shaped) profile in a vertical cross section taken in the transportation direction D and a bow. The contact portion 58 has at least a surface formed from a material with small frictional resistance against the sheet-shaped media 9.

As illustrated in FIG. 8, the contact portion 58 according to the second exemplary embodiment includes a slope 58*c*, extending obliquely downward toward the downstream side in the transportation direction D. Specifically, the slope 58*c* in the contact portion 58 is a curved surface extending to a lowermost portion 58*a* of the contact portion 58 with a curvature larger than the curvature of a surface portion in the contact portion 58 extending from the lowermost portion 58*a* to the downstream end of the contact portion 58 in the transportation direction D. Thus, the sheet-shaped media 9 smoothly pass the contact portion 58 while less frequently getting caught with the contact portion 58 while being discharged.

As illustrated in FIGS. 7 and 8, in each of the second limiters 57A and 57B, the height of the contact portion 58 that comes into contact with the upper surface of the sheet-shaped media 9 (strictly, the height of the lowermost portion 58*a*) is equal to or higher than the height of the lowermost portion 42*d* in the suction area VE of the suction portion 41.

In the first exemplary embodiment, the lowermost portion 58*a* has a height higher than the height of the lowermost portion 42*d* in the suction area VE of the suction portion 41. Here, the height of the contact portion 58 is, for example, determined within a range of 0.3 to 3 mm higher than the height of the lowermost portion 42*d* in the suction area VE of the suction portion 41.

As illustrated in FIGS. 7 and 8, portions of the first limiters 55A to 55F that come into contact with the upper surfaces of the left and right edges of the sheet-shaped media 9 (lower surface or a contact surface 551 in this example) have a height lower than the height of the lowermost portion 42*d* in the suction area VE of the suction portion 41. In the first exemplary embodiment, the contact surfaces 551 of all the six first limiters 55A to 55F have the height defined in the above relation. As long as the contact surfaces 551 of the six first limiters 55A to 55F satisfy the above relation in height, the contact surfaces 551 may have heights different from each other.

As illustrated in FIGS. 6 and 7, the feeder 1 includes an abnormal stack detection actuator 59 in the right first area RE. The abnormal stack detection actuator 59 is used to detect unevenness (abnormality) of the uppermost one of the stacked sheet-shaped media 9. The abnormal stack detection actuator 59 includes a movable contact portion 59*a*, which moves upward while being in contact with the upper surface of the sheet-shaped media 9, and a movable support portion 59*b*, which movably supports the movable contact portion 59*a* in the vertical direction. In the abnormal stack detection actuator 59, the movable contact portion 59*a* is movable upward also while being in contact with the upper surface of the sheet-shaped media 9. Thus, the movable contact portion 59*a* has no function of intentionally limiting the height of the sheet-shaped media 9.

As illustrated in FIG. 7 and other drawings, in the feeder 1, to stack the sheet-shaped media 9 on the mount portion 20A of the feed unit 12 on the upper side and the mount portion 20B of the feed unit 13 on the lower side, the container 17A and the container 17B in the feeder units 12 and 13 are pulled out to the near side of the housing 10 for the stacking operation.

Here, pulling out the container 17A and the container 17B detaches the coupling mechanism 36 in the lift 30. Thus, the rotation shaft 35 and the driving device 37 in the lift 30 are disconnected. Thus, the mount portion 20A and the mount portion 20B are lowered by their own weight to their lowermost positions. The lowermost position of the mount portion 20A or the like is, for example, the position where the hanging portions 22*a*, 22*b*, 22*c*, and 22*d* come into contact with the lowest end portions of the guide holes 174. After the sheet-shaped media 9 are stacked on the mount portion 20A or the like, the left and right side walls 25L and 25R and the rear end wall 26 are moved to the positions where they respectively come into contact with or approach left and right edges and the rear end for adjustment in accordance with the size of the stacked sheet-shaped media 9.

After the operation of stacking the sheet-shaped media 9 is finished, the container 17A and the container 17B are pushed into the housing 10 to be retracted. Thus, the coupling mechanism 36 in the lift 30 is coupled again, so that the rotation shaft 35 and the driving device 37 in the lift 30 are coupled.

Operation of Feeding Sheet-Shaped Media

The sheet-shaped-medium feeder 1 feeds the sheet-shaped media 9 in the following manner.

Specifically, the feed unit 12 on the upper side in the feeder 1 will be described as an example. First, inside the container 17A, the mount portion 20A is moved upward by the lift 30 simultaneously taking up the wires 31*a*, 31*b*, 31*c*, and 31*d* until the upper one of the sheet-shaped media 9 stacked on the mount portion 20A reaches the predetermined height.

Figure 9:
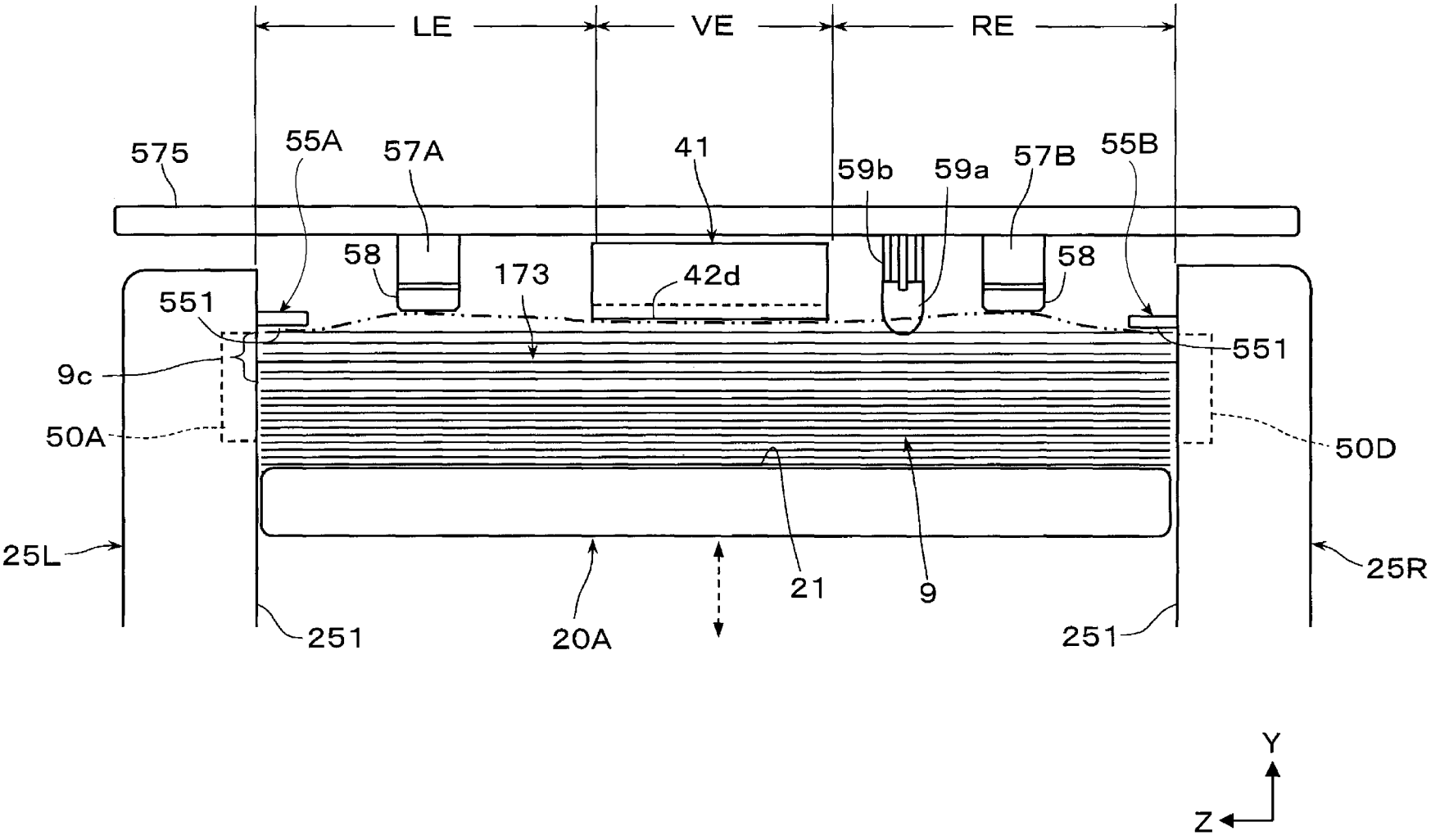
FIG. 9 is a schematic diagram of the feeder illustrated in FIG. 2 in one state during a feeding operation.

Subsequently, as illustrated in FIG. 9, at the mount portion 20A, air is discharged from the multiple air outlets 50A, 50B, 50C, and 50D in the left and right side walls 25L and 25R, so that multiple upper sheet-shaped media 9*c* among the sheet-shaped media 9 float upward with air flow and separate from each other.

Figure 10:
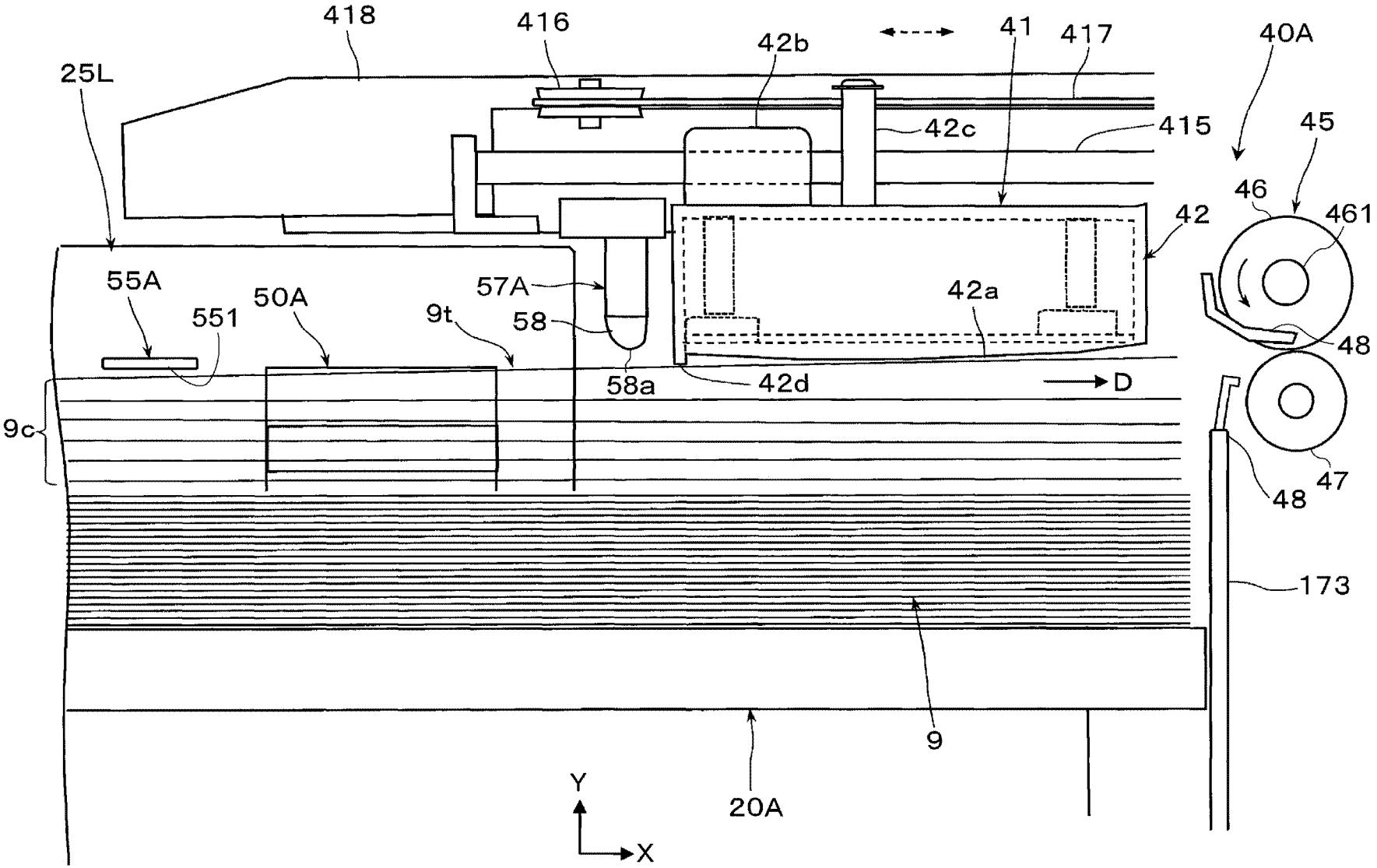
FIG. 10 is a schematic diagram of the feeder in one state during the feeding operation illustrated in FIG. 9, viewed in a different direction.

Here, as illustrated with chain double-dashed lines in FIG. 5 and solid lines in FIG. 10, among floated sheet-shaped media 9*c* that have moved upward, the upper surface of an uppermost sheet-shaped medium 9*t* has left and right edges come into contact with the contact surfaces 551 of the first limiters 55A to 55F. Thus, the floated ones of the sheet-shaped media 9*c* are stopped from moving further upward to have its height limited.

In the container 17A, the leading end portion, in the transportation direction D, of the uppermost sheet-shaped medium 9*t* among the floating sheet-shaped media 9*c* is sucked at the suction area VE surrounded by the lower end of the frame 42 by receiving a suction force from the suction portion 41 of the discharger 40A. Here, the suction portion 41 is stationary at a suction position where it performs the suction operation.

Subsequently, in the feeder 1, the suction portion 41 of the discharger 40A moves to transport the leading end portion of the sucked sheet-shaped medium 9*t*, disposed downstream in the transportation direction D, to a delivery position where the suction portion 41 passes the leading end portion to the transport portion 45 to deliver the leading end portion to the transport portion 45. Specifically, the leading end portion of the sucked sheet-shaped medium 9*t* is guided to the contact portion between the driving transport roller 46 and the driven transport roller 47, which are a pair of rollers in the transport portion 45.

Subsequently, the transport portion 45 of the discharger 40A transports the delivered sheet-shaped medium 9*t* out of the mount portion 20A and the container 17A with a transport force to feed the sheet-shaped medium 9*t* to the first transport path Rh1.

Here, the sheet-shaped medium 9*t* moves in the transportation direction D while having the left and right edges guided in contact with the contact surfaces 251 of the left and right side walls 25L and 25R. Thus, the sheet-shaped medium 9*t* is transported in a normal state without skewing during transportation.

When finishes transporting the sheet-shaped medium 9*t* to the transport portion 45, the suction portion 41 temporarily stops the suction force and moves to return to the original suction position away from the transport portion 45.

Thus, after the sheet-shaped media 9 are discharged from the feed unit 12 on the upper side through the discharge port 18 via the first transport path Rh1, the sheet-shaped media 9 are fed to the image forming apparatus 120A (the first introduction transport path Rt1 of the image forming apparatus 120A), serving as an example of a destination.

In the feeder 1, in substantially the same manner as in the feeding operation from the feed unit 12 on the upper side, after the sheet-shaped media 9 stacked on the mount portion 20B are also discharged from the feed unit 13 on the lower side through the discharge port 18 via the second transport path Rh2, the sheet-shaped media 9 are fed to the destination.

In the feeder 1, the feed unit 12 on the upper side and the feed unit 13 on the lower side transport the sheet-shaped media 9 after temporarily sucking the sheet-shaped media 9 with the suction portion 41. Thus, some of the sheet-shaped media 9 such as sheet-shaped media 9P that are thin, wide in a feed width, and thus weak as a whole may cause the following transport failures.

Figure 11:
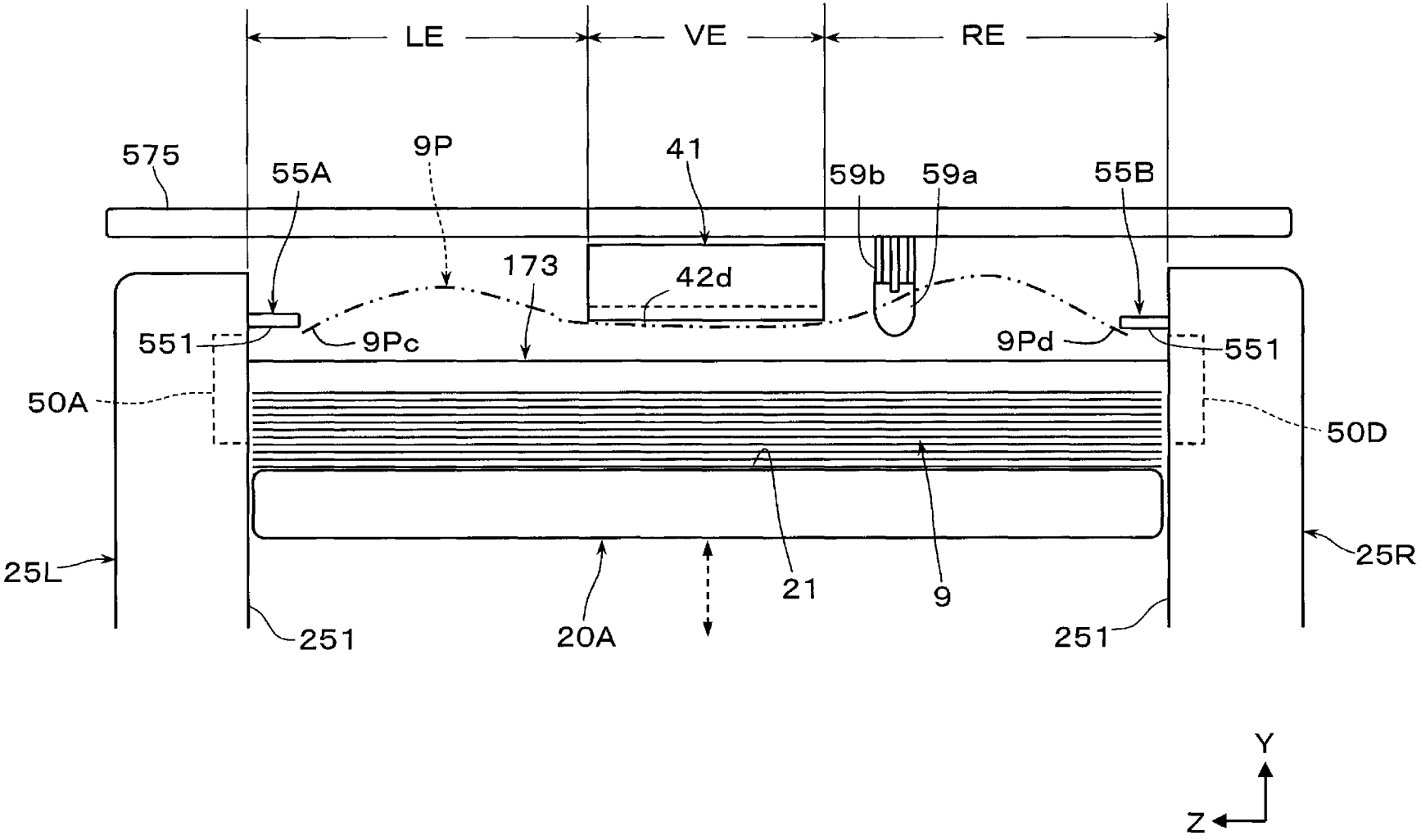
FIG. 11 is a schematic diagram of a feeder according to a comparative example in one state during the feeding operation.

Specifically, the sheet-shaped media 9P are more likely to move upward over the mount portion 20A or the like with air blown from the air outlets 50A, 50B, 50C, and 50D, and may be deformed, for example, as illustrated in FIG. 11, to bend convexly in the first areas LE and RE between the suction area VE of the suction portion 41 in the discharger 40A and the left and right side walls 25L and 25R (contact surfaces 251 thereof). With this deformation, the sheet-shaped media 9P have the left and right edges 9Pc and 9Pd spaced apart from the contact surfaces 251 of the left and right side walls 25L and 25R while leaving gaps therebetween.

Here, in some cases, at least one of the left and right edges 9Pc and 9Pd of the sheet-shaped media 9P may slip by the corresponding one of the contact surfaces 551 of the first limiters 55A and 55B and fail to be guided by the contact surface 251 of the left or right side wall 25L or 25R during discharging, and thus may be transported in a skewing position. Here, even when the left and right edges 9Pc and 9Pd of the sheet-shaped media 9P do not slip by the contact surfaces 551 in the first limiters 55A and 55B, the gap thus formed may prevent the left and right edges 9Pc and 9Pd from being normally guided by the contact surfaces 251 of the left and right side walls 25L and 25R during discharging, and thus the sheet-shaped media 9P may be transported in a skewing position.

In contrast, in the feeder 1 according to the first exemplary embodiment, as indicated with a chain double-dashed line in FIG. 9, when the sheet-shaped medium 9P is to be deformed to bend convexly in the first areas LE and RE, the upper surface of the sheet-shaped medium 9P that is to be deformed to bend convexly comes into contact with the contact portions 58 of the left and right second limiters 57A and 57B disposed in the first areas LE and RE, to have the height of the upper surface limited.

Thus, the feeder 1 further prevents the sheet-shaped media 9P from being deformed to bend convexly in the first areas LE and RE, than in a structure not including the second limiters 57A and 57B (FIG. 11).

The feeder 1 thus prevents the sheet-shaped media 9P from being deformed to bend convexly. Thus, gaps resulting from the left and right edges 9Pc and 9Pd being spaced apart from the contact surfaces 251 of the left and right side walls 25L and 25R are reduced.

Thus, the left and right edges 9Pc and 9Pd of the sheet-shaped media 9P are prevented from slipping by the contact surfaces 551 of the first limiters 55A and 55B, and the sheet-shaped media 9P are prevented from failing to be normally guided by the contact surfaces 251 of the left and right side walls 25L and 25R during discharging. Thus, the sheet-shaped media 9P are prevented from being transported in a skewing position.

In the image forming system 100A, when the feeder 1 feeds the sheet-shaped media 9P, the feeder 1 is capable of efficiently transporting the sheet-shaped media 9P to the image forming apparatus 120A, serving as a destination.

Here, in the feeder 1, when the sheet-shaped medium 9P is deformed to bend convexly in the first areas LE and RE, part of the upper surface of the sheet-shaped medium 9P comes into contact with the abnormal stack detection actuator 59 in the right first area RE. Here, the movable contact portion 59*a* of the abnormal stack detection actuator 59 moves upward without limiting the height of the sheet-shaped medium 9P.

Compared to a structure not including the second limiters 57A and 57B in the second area DE, the feeder 1 reliably prevents, for example, the sheet-shaped media 9P from floating and bending convexly in the first areas LE and RE with the second limiters 57A and 57B.

Compared to a structure where the heights of the contact portions 58 of the second limiters 57A and 57B are lower than the height of the lowermost portion 42*d* in the suction area VE of the suction portion 41, the feeder 1 prevents, for example, the sheet-shaped media 9P from floating and bending convexly in the first areas LE and RE with the second limiters 57A and 57B without the sheet-shaped media 9P being prevented from being sucked by the suction portion 41.

Compared to a structure where the heights of the contact surfaces 551 of the first limiters 55A to 55F are higher than the lowermost portion 42*d* in the suction area VE of the suction portion 41, the feeder 1 prevents, for example, the sheet-shaped media 9P from floating and bending convexly with the second limiters 57A and 57B without interrupting air blown to the left and right edges of the sheet-shaped media 9P.

Compared to a structure where the contact portions 58 of the second limiters 57A and 57B have a shape other than a shape with a long dimension in the width direction of the sheet-shaped media 9, the feeder 1 widely and efficiently prevents, for example, the sheet-shaped media 9P from floating and bending convexly with the second limiters 57A and 57B.

Compared to a structure where the contact portions 58 of the second limiters 57A and 57B have a shape other than a shape with a convex surface protruding downward when viewed in the transportation direction D, the feeder 1 prevents, for example, the sheet-shaped media 9P from floating and bending convexly with the second limiters 57A and 57B with reduction of the frictional resistance of the second limiters 57A and 57B when coming into contact with the sheet-shaped media 9 (9P) without possibility of causing transport troubles.

Modification Example

In the feeder 1 according to the first exemplary embodiment, the height of the contact surfaces 551 of the first limiters 55A to 55F may be the same as the height of the lowermost portion 42*d* in the suction area VE of the suction portion 41.

Instead of the wires 31, line members such as belts may be used in the lift 30 in the feeder 1 according to the first exemplary embodiment. When no container 17 is included, the lift 30 may be disposed at any appropriate portion of the housing 10. The lift 30 may have a mechanism other than a mechanism of hanging the containers with line members.

The first exemplary embodiment has described, as an example of the sheet-shaped-medium handling apparatus 100, the image forming system 100A including the image forming apparatus 120A serving as the processing device 120, but this is not the only possible structure. The handling apparatus 100 may be any apparatus that includes the processing device 120 that performs predetermined processing on the sheet-shaped media 9 fed from the feeder 1.

Examples of the handling apparatus 100 include a printing system including the processing device 120 used as a printer that attaches ink to the sheet-shaped media 9 and other media, a painting system including the processing device 120 used as a painting device that applies a liquid paint to the sheet-shaped media 9 and other media, and a drying system including the processing device 120 used as a dryer that dries the sheet-shaped media 9 and other media.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet-shaped-medium feeder, comprising:

a housing;

a mount portion that is disposed to be vertically movable in the housing and that receives sheet-shaped media;

a lift that vertically raises or lowers the mount portion;

a discharger that transports the sheet-shaped media stacked on the mount portion to a transport portion by sucking the sheet-shaped media with a suction portion in order from an upper one of the sheet-shaped media;

left and right side walls that come into contact with left and right edges, in a feed width, of the sheet-shaped media stacked on the mount portion;

left and right air outlets that are disposed in the left and right side walls, and blow air to the sheet-shaped media stacked on the mount portion at the left and right edges in the feed width;

left and right first limiters that are respectively disposed on the left and right side walls, and limit a height of at least one of the sheet-shaped media that floats with air blown by the left and right air outlets by coining into contact with an upper surface of the at least one sheet-shaped medium; and left and right second limiters that are disposed in areas between a suction area of the suction portion and the left and right side walls, and limit a height of the upper surface of the floating sheet-shaped medium by coming into contact with the upper surface, wherein a portion of each of the left and right second limiters that comes into contact with the upper surface of the sheet-shaped medium has a shape with a convex surface protruding downward when viewed in the sheet-shaped-medium transportation direction, wherein the convex surface comprises an arc-shaped profile in a vertical cross section taken in the transportation direction and a bow.

2. The sheet-shaped-medium feeder according to claim 1, wherein each of the left and right second limiters is located at least in an area extending beyond the suction area of the suction portion to one of the left or right first limiters disposed upstream in a sheet-shaped-medium transportation direction and closest to the suction area.

3. The sheet-shaped-medium feeder according to claim 2, wherein a portion of each of the left and right second limiters that comes into contact with an upper surface of the sheet-shaped medium has a height that is equal to or higher than a height of a lowermost portion in the suction area of the suction portion.

4. The sheet-shaped-medium feeder according to claim 3, wherein a portion of each of the left and right first limiters that comes into contact with an upper surface of the left or right edge of the sheet-shaped medium has a height that is lower than a height of the lowermost portion in the suction area of the suction portion.

5. The sheet-shaped-medium feeder according to claim 4, wherein a portion of each of the left and right second limiters that comes into contact with an upper surface of the sheet-shaped medium has a shape with a long dimension in a width direction crossing a sheet-shaped-medium transportation direction.

6. The sheet-shaped-medium feeder according to claim 3, wherein a portion of each of the left and right second limiters that comes into contact with an upper surface of the sheet-shaped medium has a shape with a long dimension in a width direction crossing a sheet-shaped-medium transportation direction.

7. The sheet-shaped-medium feeder according to claim 2, wherein a portion of each of the left and right second limiters that comes into contact with an upper surface of the sheet-shaped medium has a shape with a long dimension in a width direction crossing a sheet-shaped-medium transportation direction.

8. The sheet-shaped-medium feeder according to claim 1, wherein a portion of each of the left and right second limiters that comes into contact with an upper surface of the sheet-shaped medium has a height that is equal to or higher than a height of a lowermost portion in the suction area of the suction portion.

9. The sheet-shaped-medium feeder according to claim 8, wherein a portion of each of the left and right first limiters that comes into contact with an upper surface of the left or right edge of the sheet-shaped medium has a height that is lower than a height of the lowermost portion in the suction area of the suction portion.

10. The sheet-shaped-medium feeder according to claim 9, wherein a portion of each of the left and right second limiters that comes into contact with an upper surface of the sheet-shaped medium has a shape with a long dimension in a width direction crossing a sheet-shaped-medium transportation direction.

11. The sheet-shaped-medium feeder according to claim 8, wherein a portion of each of the left and right second limiters that comes into contact with an upper surface of the sheet-shaped medium has a shape with a long dimension in a width direction crossing a sheet-shaped-medium transportation direction.

12. The sheet-shaped-medium feeder according to claim 1, wherein a portion of each of the left and right second limiters that comes into contact with an upper surface of the sheet-shaped medium has a shape with a long dimension in a width direction crossing a sheet-shaped-medium transportation direction.

13. The sheet-shaped-medium feeder according to claim 12, wherein the portion of each of the left and right second limiters that comes into contact with the upper surface of the sheet-shaped medium has a slope extending obliquely downward toward a downstream side in the transportation direction.

14. A sheet-shaped-medium handling apparatus, comprising:

a sheet-shaped-medium feeder that transports and feeds sheet-shaped media to be stacked thereon; and a processing device that performs processing on the sheet-shaped media fed from the feeder, wherein the sheet-shaped-medium feeder includes the sheet-shaped-medium feeder according to claim 1.

* * * * *